United States Patent [19]

Peyre

[11] Patent Number: 4,739,721

[45] Date of Patent: Apr. 26, 1988

[54] BOAT FOR VERTICAL AND HORIZONTAL TRANSFER

[76] Inventor: Xavier Peyre, Chemin du Ruvere, Chatelaudren, France, 22170

[21] Appl. No.: 829,532

[22] Filed: Feb. 14, 1986

[30] Foreign Application Priority Data

Feb. 15, 1985 [FR] France ..... 85 02223

[51] Int. Cl.[4] ..... B63B 27/30

[52] U.S. Cl. ..... 114/348; 104/114; 414/138; 114/365; 114/362

[58] Field of Search ..... 414/138, 139; 114/362, 114/365, 377, 259, 258, 348, 349; 104/112, 114

[56] References Cited

U.S. PATENT DOCUMENTS

| | | | |
|---|---|---|---|
| 2,103,708 | 12/1937 | Campbell | 114/375 |
| 2,998,148 | 8/1961 | Himel, Jr. | 414/139 |
| 3,064,829 | 11/1962 | Winfrey et al. | 414/139 |
| 3,675,900 | 7/1972 | Barron et al. | 414/139 |
| 4,025,055 | 5/1977 | Strolenberg | 414/139 |
| 4,166,545 | 9/1979 | Martinussen et al. | 414/139 |
| 4,395,178 | 7/1983 | MacDonell et al. | 414/138 |
| 4,412,598 | 11/1983 | Kimon et al. | 414/139 |

*Primary Examiner*—Joseph F. Peters, Jr.
*Assistant Examiner*—Edwin L. Swinehart
*Attorney, Agent, or Firm*—Darby & Darby

[57] ABSTRACT

This invention relates to a boat designed as a self-hoisting unit for the vertical and horizontal transfer of persons and/or equipment from a ship to an offshore platform and vice versa. The boat carries a hollow mast forming a guide for a cable, the upper end of which will be attached to a carrier structure extending outwardly from a platform or ship. The mast is held by shrouds so as to withstand large flexural strains. For compensating sea-swell, the lower end of the cable passes over a damper unit comprising an hydraulic cylinder associated with pulleys of two opposed tackle-blocks. The cable is driven by a winch so that the boat can autonomously hoist itself to the platform deck level, or lower itself down to the sea or onto the deck of a ship. The mast height is sufficient for generating an uprighting torque ensuring horizontal stability of the boat during its ascent and descent. The boat is suitable for carrying a large number of persons, for instance as a lifeboat or for a shuttle service between offshore platforms.

14 Claims, 4 Drawing Sheets

BOAT FOR VERTICAL AND HORIZONTAL TRANSFER

This invention relates to a boat designed for transferring at sea persons and/or equipment from one ship to another and more generally for transporting persons and/or equipment from one location at sea to another location at sea or on the shore.

This invention relates, more particularly, to a boat designed for transferring persons and/or equipment from a marine oilfield operating site, such as an off-shore drilling platform or a drilling vessel, to another ship or to the shore. This boat is also intended to be capable of carrying a substantial number of persons, for instance for the trans-shipment of occupants of a barge-hostel at sea or for carrying ashore passengers of a cruise ship when this ship has to remain far from the shore, due to shallow waters or to the lack of harbor facilities.

BACKGROUND OF THE INVENTION

In off-shore drilling operations, helicopters have immediately been regarded as the one and only quick, effective and safe means, as they can solve both the problem of trans-shipment and the problem of transferring people and materials from one location to another. However, it has been found that helicopters were very expensive to operate and that they did not offer as much safety as could have been expected; in a case of squalls or fog, helicopters are practically not usable.

For these same reasons, helicopters are not currently being used for the transfer of cruise ship passengers. Due mainly to economical reasons and safety considerations, the use of launches has been reverted to. On another hand, many industrial firms have proposed various systems such as a gangway supported by an air-cushion, or an elevator controlled by a computerized servo-drive.

French Pat. No. 82.15164 corresponding to U.S. Pat. No. 4,650,542 describes a trans-shipment nacelle associated with a crane so as to settle down on the deck of an underlying ship. This type of nacelle which is capable of settling down gently onto the ship as it compensates the effects of sea-swell, provides an effective solution for the vertical transfer of a dozen persons from a platform to a ship. However, it is not suitable for the large numbers of persons who may have to be transferred out of a barge-hostel and, further, it cannot move horizontally for carrying passengers from one ship to another, for instance, or for carrying them ashore or transferring them from one platform to another.

This nacelle system has the further drawback, which also affects the two earlier solutions, namely the servo-drive elevator and the air-cushion gangway, of depending on external means located on the platform or on the higher ship, namely operators, as the crane operator will be on the platform, and technical facilities, such as a crane, a computerized servo-drive, an air-cushion system. As a result, the solution known hitherto lack flexibility and autonomy.

It is an object of this invention to provide a new autonomous system which will not be dependent on the ships or platforms between which transfer is being made. A further object is to provide an autonomous system capable of effective vertical trans-shipment as well as horizontal transport across the water, even in bad weather and for a large number of persons at a time.

SUMMARY OF THE INVENTION

In order to achieve this purpose, the invention provides a boat capable, through its own means, of connecting itself through a cable to an overhanging ship or platform, of hoisting itself along this cable up to the level of the ship deck or platform deck, of lowering itself from said deck and of settling down gently on the sea or on a rigid surface subjected to the effects of sea-swell, and then of resuming its normal operation as a boat.

The boat according to this invention is characterized by the following features:

its hull is provided with a rigidly cylindrical and vertical hollow guide, open at both ends, located approximately in vertical alignment with the boat's center of gravity, the linkage between the hull and the guide being provided so that the guide will be able to resist large flexural strains, this boat comprises a cable sliding through said hollow guide and cooperating with traction means located below said guide so that when the upper end of said cable is attached to an overhanging receiver platform or ship, the boat can ascend and descent along this cable, the guide provides through its lower and upper ends two contacting areas which are sufficiently distant from each other for automatically generating on the taut cable an upright torque, thus ensuring horizontal stability of the boat during its ascent or descent travel along the cable.

The boat according to this invention is also characterized by the following further features:

the rigid vertical guide member is capable of withstanding vertical cmpression strains against the carrier structure of the platform or ship so that the boat will be immobilized by such compression strains;

the rigid vertical guide is capable of supporting the weight of the boat when this boat is not being used and when the cable is no longer subjected to the pull of the traction means;

the upper mouth of the guide comprises automatic orienting means designed for cooperating with corresponding means arranged on the receiver platform or ship so as to guide the boat's position relative to the platform at the instant when the boat becomes immobilized, and safety locking means.

These orienting means are preferably in the form of two plates provided with spiral ramps comprising safety locking members, one of said plates being mounted on the top of the guide and the other on a carrier structure of the platform or ship so as to use the vertical ascending force for causing the boat to turn about the guide axis just before being immobilized;

the boat comprises means allowing the hull to become automatically oriented in the eye of the wind or windward direction so that it will be facing the waves when splashing down.

Preferably, the orienting means are shrouds formed of rigid plates parallel to the longitudinal axis of the hull. These shrouds have a generally trapezoidal shape and are fixed to the hull at their larger base;

the pulling means consist in a capstan or a friction winch;

between the lower outlet of the guide and the capstan, the cable runs through an hydaulic damper.

In a preferred embodiment, the hydraulic damper is a cylinder and piston cooperating with tackle blocks arranged horizontally, approximately along the horizontal axis of the hull, the tackle being formed by two groups of at least four opposed pulleys, the pulleys in each group being placed at right angles around the hydraulic damper;

the hydraulic jack is connected to a compressed gas accumulator circuit comprising a valve for setting the initial operating pressure;

the bottom of the boat comprises means enabling it to rest steadily on a planar surface.

According to preferred embodiments of the invention, the boat may have a flat bottom or be of a catamaran i.e. twin-hull type, without being limited to these designs.

On another hand, one modified embodiment of the invention may advantageously have a hull bottom comprising an opening giving passage to the lower end of the cable so that this end may be hooked onto an anchoring point, by means of a hook provided with a safety device such as a break-off device or other.

In its preferred embodiment of the invention, the boat is a catamaran with dissymmetrical hulls, the inner vertical walls having a helical shape, which is known per se, each hull comprising a propulsion unit of the water-jet type, the boat further comprising between the hulls an hydraulic damper adapted for damping the horizontal effect of sea-swell.

To describe the operation of the boat in a genral way, the boat is brought approximately in vertical alignment with a mooring point on a receiver platform or ship, a mooring line is cast from the boat with the help of any suitable means and this line is firmly fixed, after which a hoisting winch installed in the boat is actuated for hoisting up the boat until it reaches the mooring point on the patform. During all its upward path, the boat remains in stable horizontal position, facing the wind, thanks to the shrouds on the one hand, and to the self-stabilizing guide, on the other hand. Upon its arrival against the mooring point on the platform, the boat will be automatically oriented along the direction requested for the transfer of passengers, and will be completely immobilized by the effect of compression against the mooring point. The passengers will then be allowed to disembark or to come aboard.

When the boat is in elevated position and has to be lowered, the initial start-off pressure is adjusted, and the boat is lowered to the sea level by means of the winch; if the boat has to settle on the deck of a ship, the descent will be interrupted for hoooking onto the ship deck the lower end of the cable hanging under the boat and for drawing the cable tight.

The invention will now be further described, referring to the appended drawings given by way of non-limitative example, in which:

FIG. 1 is an overall diagrammatic view, partly cut-out, of the boat according to the invention, FIGS. 2*a* and 2*b* are two general views showing the boat being transferred from a platform to the sea, FIGS. 3 and 4 show the boat from the rear, FIG. 5 shows the boat seen from above, FIG. 6 shows the boat being lowered from a platform onto the deck of a ship, FIG. 7 is a cross-section view of the anchoring point on the ship of FIG. 6, FIG. 8 is a diagrammatic view of the hydraulic circuit forming part of the invention.

DETAILED DESCRIPTION OF THE INVENTION

Figure 1:
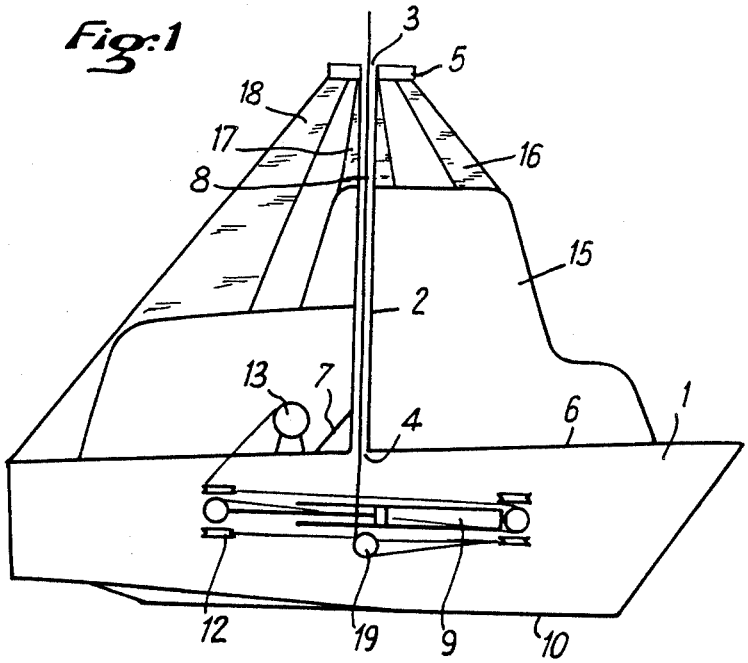
Figure 2B:
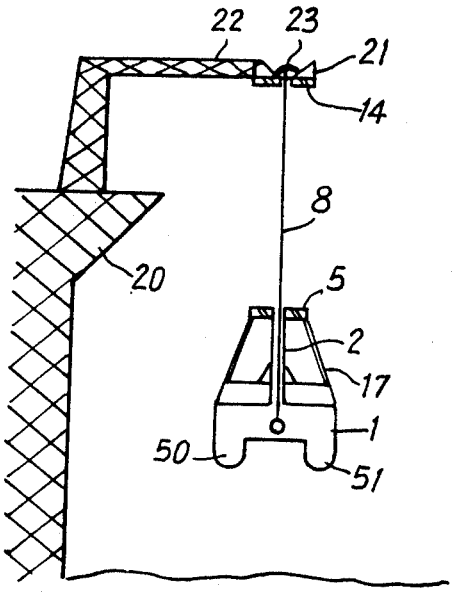
Figure 2A:
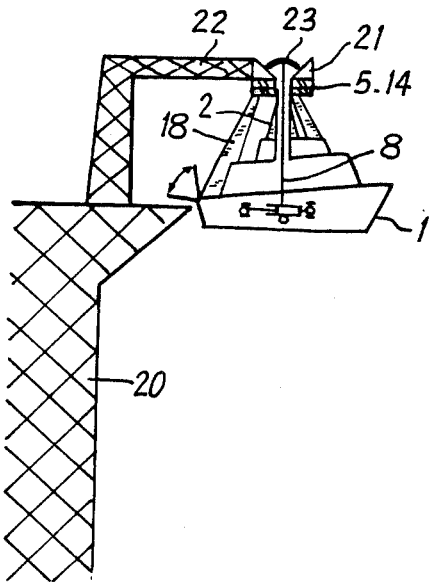
Figure 3:
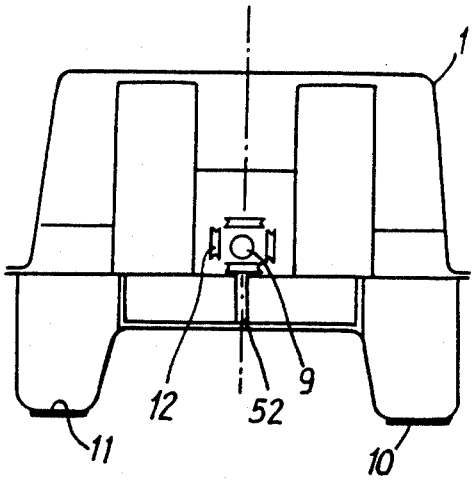

Referring now to FIG. 1, this shows a boat 1 provided with a guide member 2 which is a hollow cylindrical vertical body, open at both ends 3 and 4, and having the general shape of a mast. The axis of this guide runs approximately through the center of gravity of the boat. The guide 2 is firmly attached to the hull by its lower end 4 and by shrouds 16, 17, 18 so as to withstand flexural stresses when the boat is suspended.

A cable 8 having sufficient strength for carrying the boat, its equipment and passengers, passes successively:

through the mast-shaped guide member 2, from the top to the bottom, over a return pulley 19 upon which the force for lifting the boat is applicable, this pulley being arranged so that its entry groove will be approximately in registry with the vertical axis of the guide member 2, over the pulleys forming part of pulley blocks arranged on both ends of an hydraulic cylinder and piston unit 9 located horizontally between the twin hulls of the catamaran, this jack unit 9 being provided on each of its opposed ends with a group of four pulleys 12, this jack being connected to a compressed gas accumulator circuit (shown diagrammatically in FIG. 8), which includes a venting valve and a "quarter-turn" control valve, over a capstan 13 or a friction winch driven by the boat's engine.

The lower end of cable 8 may be attached to the capstan or else coiled down on the boat's bottom when it is not being used, or else again it may remain free, being provided with a hook.

The invention thus consists in passing through a guide member bound up with the boat a cable pulled by a capstan located in the boat, beyond the lower end of said guide member. When the upper end of this cable is attached to a platform or to a receiver ship located above the boat, the cable can be tensioned by the capstan so that it will raise the boat.

For a proper use of the invention, it is essential that the boat, as it hangs from a cable, may remain stable and horizontal, whatever may be the distribution of weight along and across the boat. This stability is achieved by placing the application point of the hoisting force below the guide member, i.e. on the return pulley 19. In fact, the axis of the guide member 2 runs approximately through the center of gravity of the boat. When this center of gravity is shifted (for instance when passengers move astern), the boat will tend to lean towards the side where the center of gravity is shifting. The mast-shaped member guide, being bound with the boat, will also lean at an angle to the vertical. The taut cable will then develop a reaction force applying against the top end 3 of the guide member, on its mouth. The cable portion being taut between the top end 3 of the guide member and the application point of the hoisting force, namely pulley 19, will form a lever arm on the top end of which the reaction force is applied, thus preventing any extensive swaying of the boat. It should be stressed now that, heavier will the boat be, greater will be the reaction force for stabilizing the boat. This shows the crucial importance of the arrangement of the guide member and of the application point of the hoisting force below this guide member. It also shows the importance of having a rigid connection of the guide member with the hull. Naturally, the larger will be the distance between the top mouth 3 of the guide member and the pulley 19, thus the length of the mast-shaped guide member, the greater will be the stability.

This great stability of the boat will then make it possible:

to carry conveniently a large number of persons who can embark while the boat is suspended by the cable, without appreciably disturbing the balance of the boat. The number of passengers is restricted only by the size of the boat and by the cable strength, to carry heavy equipment, so that the boat may be used as a floating workshop or as a workshop suspended to an operational platform.

The mast-shaped guiding member 2 comprises on its upper end a mouthpiece 3 provided with orienting and compression means 5 cooperating with mating means 14 shown diagrammatically on FIGS. *2a* and *2b*. These means are designed on the one hand to automatically orient the boat as it reaches a fixed mooring point on a platform or a ship, the boat's orientation being predetermined so as to facilitate the exit of passengers or equipment, and on the other hand for pressing the boat against this mooring point so as to keep the boat steady for the transfer of passengers between two surfaces which remain fixed, relative to each other. Finally, these orientation and compression means make it possible to moor the boat and to keep it firmly moored when the cable is no longer taut, i.e.; at rest. Therefore, these orientation and compression means 5 must be bound very firmly to the guide member 2 which in turn will be very firmly bound to the boat hull 6 for withstanding compression and flexural stresses, the latter arising more particularly from the movements of passengers on the deck as they embark or disembark.

In the embodiment described here, the device shown in 5 is a circular plate having a hollow central portion for giving passage to the cable. This plate 5 is provided with lateral spiral ramps. The mating device 14 is a hollowed-out circular plate provided with radial notches for installing the cable and presenting spiral grooves which cooperate with the spiral ramps of plate 5. However, this example of an embodiment is not limitative, and the device may be constructed with concial surfaces provided with helical ribs or any other type of surface.

Plates 5 and 14 are provided with safety locking members which keep them assembled together after compression of plate 5 against plate 14 is released. These locking members are controlled from the steering cabin. Thus, when plate 5 approaches plate 14, the ramps engage in the grooves, causing the boat to pivot towards the desired orientation. At the end of the stroke, the plates contact each other and, as the capstan is still running, the plates are firmly pressed together, so that the boat is completely immobilized against the bracket 22. The pilot may then actuate the locking device for locking the two plates together, while keeping the cable taut and then release the cable tension. The boat will then be in a rest position or in a waiting position.

The fixation of the guide member 2 to the hull 6 may for instance have a tripod shape, such as 7, but any other linking system may be used as long as it enables the guide member to withstand the initial compression strains and the weight of the boat being kept in the air by the safety locking devices on the guide member.

Figure 4:
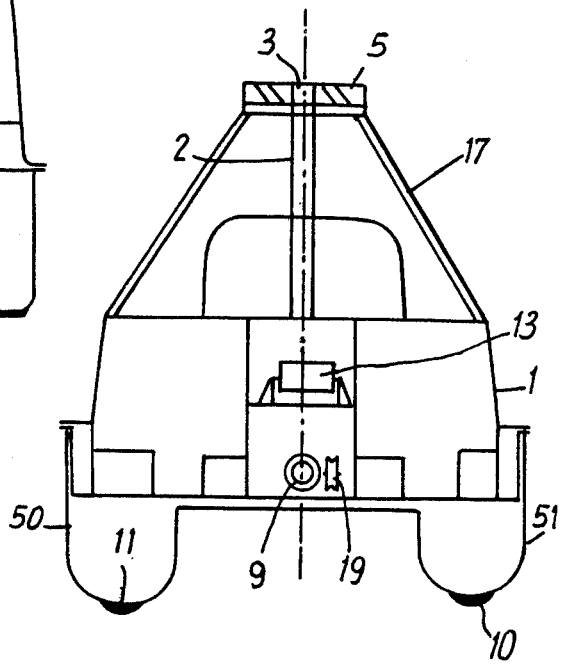
Figure 5:
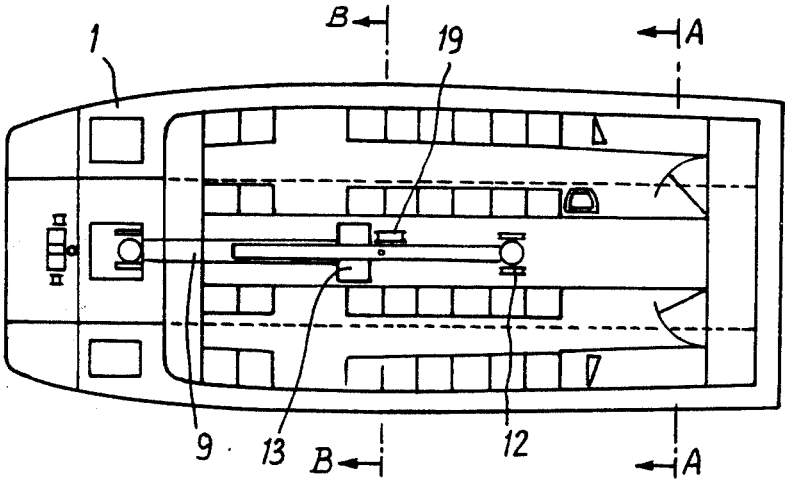

It is a requirement that the boat may be lowered to the surface of the sea under optimal conditions. In calm weather, this offers no difficulty, but in rough weather the best conditions are obtained with the boat facing the waves. Referring to FIG. 1 and 4, it can be seen that the boat is provided, between the top of the mast-shaped guide member 2 and the hull 6 or the steering cabin 15, with pairs of rigid shrouds 16, 17, 18 having the form of plates parallel to the longitudinal axis of the boat. Each pair of shrouds is symmetrical about this axis, so as to balance wind forces on each side of the boat and thus provide for a stable position in the eye of the wind.

These plates 16, 17, 18 have therefore two functions, as wind deflectors and as shrouds, since their rigidity is also contributing to the resistance of the guide member against stresses caused by a swaying of the boat.

The shrouds 16, 17, 18 have a general trapezoidal shape, this being only an example of shape. Their upper end is fixed to the orientation and compression plate 5 and their lower base is fixed to the outside planking of the boat.

In a preferred embodiment of the invention, the boat is hoisted vertically by a capstan 13. Referring to FIGS. 1 through 5, it can be seen that there is located between the base of the guide member 2 and the capstan 13 an hydraulic jack 9 equipped with pulley blocks for compensating the effects of sea-swell. The tackle comprises four identical opposed pairs of sheaves 12, mounted perpendicular to each other around the hydraulic cylinder 9. This makes it possible to use a short cylinder which requires only a small space, while the multiple cable strands make it possible to obtain a long vertical stroke in the case of a strong swell.

The tackle is installed horizontally between the hulls 50, 51 of the boat, approximately along the lengthwise axis of the boat. With this arrangement, the cable issuing from the lower end 4 of the guide member passes over a return sheave 19 and then over each one of the eight sheaves of the tackle, and hence is attached to the capstan.

Figure 8:
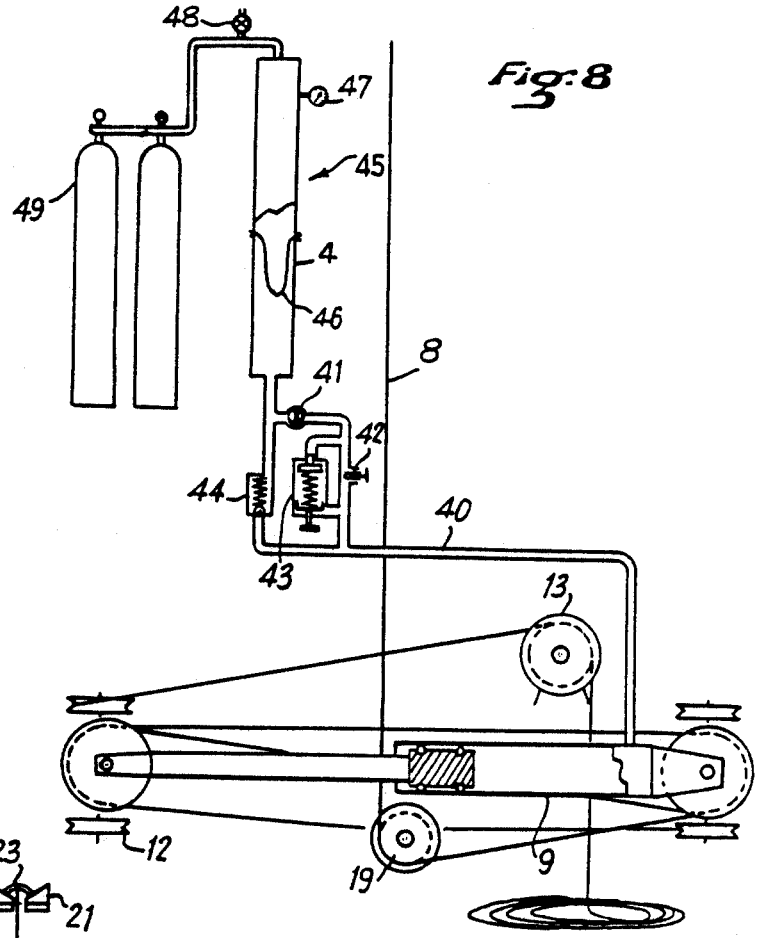

The damping system 9 is a hydraulic cylinder connected to a compressed gas accumulator circuit 40 of the type disclosed in French Pat. No. 82.15164 and is placed between the hulls. It is shown in FIG. 8 and comprises a "quarter-turn" control valve 41, an oil flow regulating valve 42 in parallel with a safety valve 43, and a non-return valve 44 in parallel with the circuit. The accumulator 45 comprises a bladder 46 or a free piston separating the gas and the oil. A relief valve 48, a pressure gauge 47 and a cylinder 49 holding pressurized gas and connected to the accumulator make it possible to modify the initial pressure.

The damping system must be capable of absorbing the sea-swell in both cases, when the boat is lowered down to the sea or when it comes to rest on the deck of a ship. The initial pressure will be different in either case:

when the boat is lowered at sea, the contact with the sea may be a shock affecting the whole structure of the boat. The damper will absorb this shock by relieving the boat of a fraction of its weight. The initial pressure corresponds to this relieving action, when the boat is used as a nacelle,it is attached firmly to the ship by tightening onto the ship deck the cable hanging below the boat. The initial pressure will not relieve the boat's weight, but will compensate the height variation between the deck of the ship affected by sea-swell and the fixed platform. The pressure is therefore different in each case.

OPERATION

The operation of the boat of the invention is as follows:

In the example described here, the fixed structure is a platform 20, but it might also be a ship.

The boat is hooked onto the end 21 of a gantry 22 and held in place by the orientation and compression device 5,14.

The gantry 22 is an example of a fixed mooring point fixed to the stationary structure 20 (a platform, a ship or a wharf) to which the upper end of the cable may be hooked. However, the cable may be passed over or through the fixed mooring point, caused to slide for hooking it to the boat in any known manner.

In the example shown, the mooring point is located at the end of an arm 21 of a gantry 22 overhanging the boat in vertical alignment with the guide member 2 of the boat. The distance from this vertical alignment to the edge of the platform is approximately equal to the distance from the mast to the poop of the boat, so that the boat's transom may come alongside the platform for allowing passengers to embark or disembark from the stern.

However, this requirement is not limitative, and it will also be of advantage to provide a gangway with an adjustable length for adapting the system to various types of gangways existing on ships.

The cable passes through the orientation and compression device 5, 14 and is hooked to the gantry arm by a mooring line 23.

First case: lowering the boat to sea-level

The boat is in waiting position, the piston stroke in cylinder 9 of the tackle is at maximum extension, valves 41 and 42 are open.

The pilot sets the initial pressure of accumulator 45 with the help of the pressure gauge 47 and of the venting valve 48. The pilot starts the engine and engages the clutch of the capstan for tightening the cable and immobilize the boat through compression. He will then unlock the orientation and compression device 5, 14. At this time, the cable is tensioned and the orientation and compression plate 5 on the end of the guide member 2 is pressing against the orientation and compression plate 14 of the gantry 22. Passengers walk aboard the boat. The pilot initiates the descent.

The boat orients itself into the eye of the wind and reaches the water, facing the waves. Contact with the water is gentle, thanks to the damper system which absorbs the reaction of the boat's weight on the water.

The pilot releases the mooring line 23 from its upper fixation point with the help of any known device (secondary cable, electromagnetic or acoustic control, etc. . . . ), coils down the cable in the boat and sails away from the platform.

Second case: ascent from the sea to a platform

The boat arrives close to another platform. The pilot throws the cable 8 onto the fixed orientation and compression point 21 with the help of any known device such as a line-throwing gun, and fixes the line 23 firmly.

The pilot engages the clutch of the capstan which winds the cable so as to raise the boat.

The boat will then reach the top, being oriented in the eye of the wind. As soon as the orientation and compression plates 5, 14 come into contact, plate 5 pivots automatically so that the exit gangway of the boat comes in registry with the platform gangway. The pilot causes the plates 5 and 14 to be pressed together and immobilizes the boat.

The passengers leave the boat, the two plates can then be locked and the engine stopped. The boat is in rest position.

Figure 7:
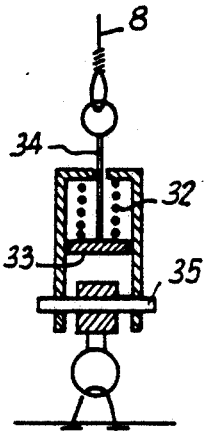
Figure 6:
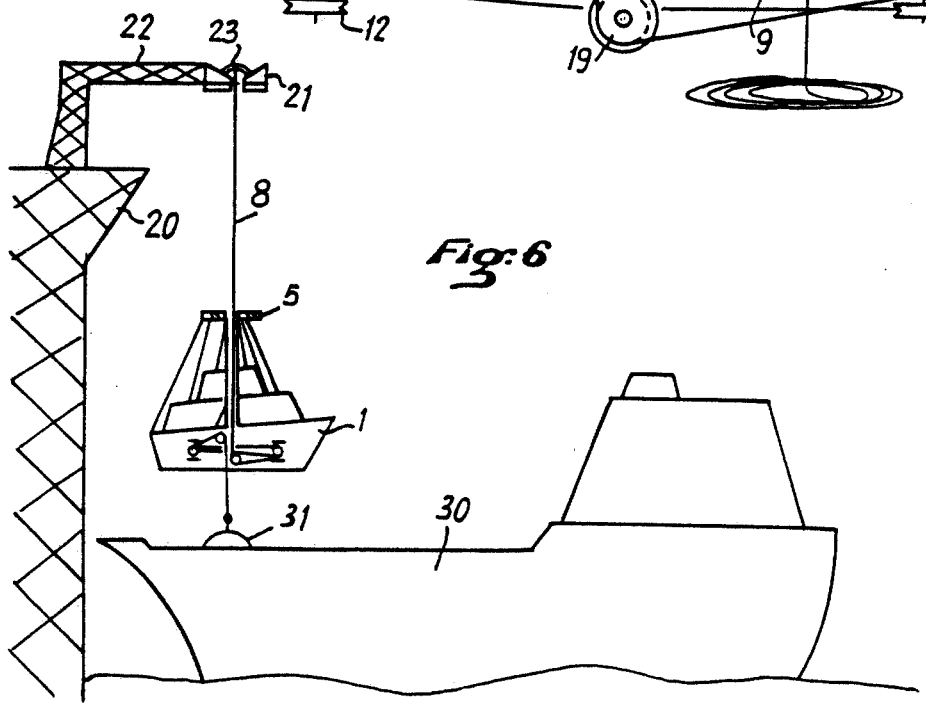
Figure 10:
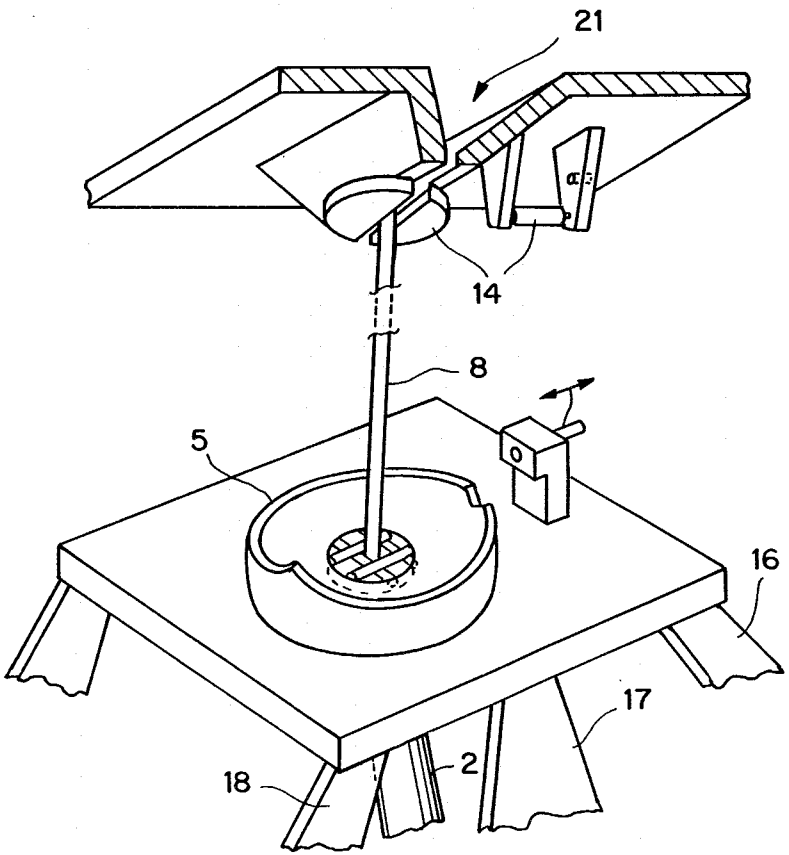
Figure 9:
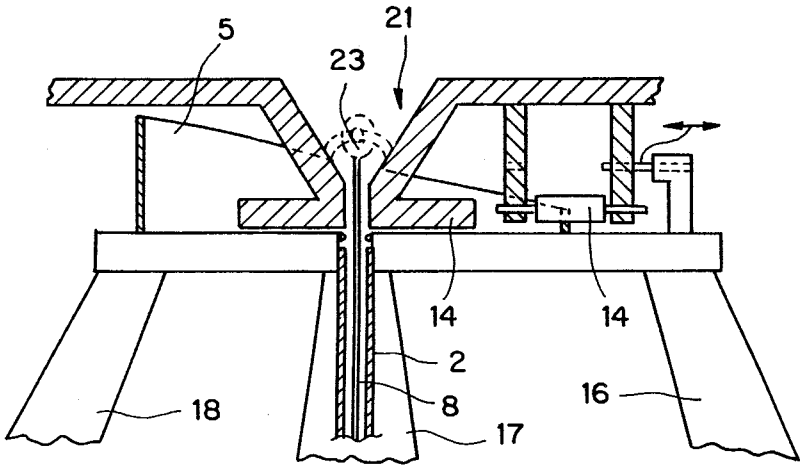

Third case: modification: transshipment from the deck of a ship to a platform A modified way of using the boat consists in operating this boat as a transshipment nacelle, for instance between a platform and a surface subjected to heaving forces, such as the deck of a ship in a swelling sea. In this modified form shown in FIG. 6, the lower free end of the cable is hooked to the mooring point 31 on the ship deck 30, this mooring point being provided with a safety release device. FIG. 7 shows details of this mooring point which comprises a spring 32 within a cylinder between a piston 33 and the bottom of the cylinder. The piston rod 34 is attached to the lower end of cable 8. The opposed end of the cylinder is pierced with two holes through which is inserted a breakable pin 35 linked to the ship deck.

This device operates when cylinder 9 of the damping tackle is fully compressed and the cable becomes too taut. If the excess of tension remains moderate, the spring 32 will be compressed, but if it exceeds a preset value, the breakable pin 35 will give way, releasing cable 8.

Operation of the boat as a nacelle is as follows:

The boat being initially in waiting position, the piston-stroke in cylinder 9 is maximum, valves 41 and 42 being open.

The pilot sets the initial pressure at the value specified by the manufacturer for a deck landing. This setting is made by means of pressure gauge 47 and reserve gas cylinders 49. The pilot then starts the engine, engages the clutch of the capstan in the hoisting direction for tensioning the cable and immobilizing the boat in compression. When the piston is half-way in cylinder 9, the pilot closes the "quarter-turn" valve 41. Adjustments are made with the help of the pressure gauge 47. The orientation and compression device 5, 14 is then unlocked (if required); passengers walk aboard, and the pilot initiates the descent. After a descent of at least approximately ten meters (for example), the pilot stops the boat. The receiver ship positions itself under the boat, and its screw attaches the cable hanging below the boat to the mooring point 31. The pilot will then open valve 41, so that pressurized gas may push the piston at full stroke, thus tensioning the cable between the boat and the receiving ship 30. The boat will then simultaneously be hoisted up again to a height of at most approximately ten meters (for example).

The oil flow adjustment valve 42 is used for restricting oil flow, thus reducing the speed with which the boat 1 is raised again at the moment when valve 41 is opened. A safety valve 43 is connected as a by-pass to the oil flow adjustment valve 42.

At this time, the boat will follow the movements of the receiving ship 30 resulting from sea-swell, so that the boat will be motionless relatively to the ship. All vertical movements due to sea-swell will be absorbed by the damping system 9.

The pilot resumes the descent and the boat comes to rest gently on the deck 30 of the receiving ship. Passengers may then leave the boat.

For preventing any risk of the boat skidding on the ship deck 30, the outer surface of the boat hull contacting the deck 30 has a skid-proof coating 11, which may also contribute to dampen the boat's landing on the ship deck.

In the reverse direction, when transferring passengers from the ship to the platform, the boat will initially be resting on the ship deck 30. The lower end of cable 2 is attached to the safety mooring pont 30 and it is taut.

The ship positions itself approximately under the fixed mooring point 21 of the platform, the cable is attached to this upper mooring point by means of a known device such as a line-throwing gun, and the mooring line 23 is firmly fixed. The "quarter-turn" valve 41 is opened and the piston in cylinder 9 is fully extended. The pilot will then engage the capstan clutch for tensioning the cable.

Passengers come aboard the boat and the pilot initiates the ascent of the boat. After raising to a distance approximately equal to the maximum spacing from wave crest to trough, control valve 41 is closed. In the course of the ascent of the boat above the swell, slackness develops in the portion of the cable between the boat and the ship, since the piston in the hydraulic cylinder 9 is prevented from extending by the retaining valve 44 and the control valve 41, the latter being closed. The ship's crew will then release hook 31 so that the boat may hoist itself further up. When about ten metres from the mooring point on the platform, the pilot opens valve 41 and completes the ascent, as described in connection with the previous case.

For practising this modified embodiment, use will advantageously be made of a boat having a bottom 10 provided with means for achieving a steady support of the boat on the receiving surface. Thus, in the example described and shown, the boat has been represented as a catamaran, but this example is not limitative, and it is also possible to use a single-hull boat having a flat bottom 10 provided with a well 52 for passing the lower end of cable 8. The boat could also be of a multi-hull design, but preference is given to the catamaran type since it offers a free space between the hulls for installing therein the devices of the invention.

The boat may be used for transferring operating personnel from a platform to a ship and vice versa, or as a shuttle between several platforms or vessels. It can also be used as a lifeboat, or for allowing passengers to come ashore on a beach or on a floating pontoon, where it will solve the problems for transferring tourists from a ship to sites which are not easily accessible.

From another point of view, the propulsion system known as Water Jet is particularly advantageous, since:

it improves the stability of the catamaran and gives it a greater speed, thus facilitating the transfer of passengers, as soon as the boat is raised from the sea, the water contained in the propulsion unit is released to the sea, so that the boat becomes lighter and less power will be needed for driving the capstan, there is no transmission shaft between the hulls, so that there is more free space for installing the assembly of the damper and cable system.

I claim:

1. A boat comprising:

a hull, said hull being provided with a rigid cylindrical and vertical hollow guide member open at both ends, having a substantial portion extending outside the hull and located approximately in vertical alignment with the boat's center of gravity, a linkage between said hull and upper end of said guide member being provided so that the guide member will be able to withstand large flexural strains, said boat comprising a cable sliding through said guide member and cooperating with traction means located below said guide member so that when an upper end of said cable is attached to an overhanging receiver platform or ship, the boat can ascend and descend along said cable.

said guide member providing with its lower and upper ends two contact areas which are sufficiently remote from each other for automatically generating on the taut cable an upright torque, thus ensuring horizontal stability of the boat during its ascenting or descenting travel.

2. A boat according to claim 1, wherein the rigid upright guide member is constructed to withstand vertical compression strains against a carrier structure of the platform or ship so that the boat will be immobilized by such compression strains.

3. A boat according to claim 1, also including means for automatically orienting the boat hull in the windward direction so that said hull will face the waves when splashing down.

4. A boat according to claim 3, wherein the orientation means are shrouds formed of rigid plates parallel to the longitudinal axis of the hull.

5. A boat according to claim 4, wherein said shrouds have a general trapezoidal shape and are fixed to the hull through their larger base.

6. A boat according to claim 1, comprising a hydraulic damper unit through which said cable is passed, wherein the traction means include a capstan which is disposed inside the boat after the damper relative to the lower opening of the guide member.

7. A boat according to claim 6, wherein the hydraulic damper unit includes tackle blocks formed of two opposed groups of four pulleys, the assembly of the hydraulic cylinder and tackle blocks being arranged horizontally and approximately parallel to the longitudinal axis of the hull, pulleys in each block being placed at right angles around the hydraulic cylinder.

8. A boat according to claim 7, in which the hydraulic cylinder is connected to a compressed gas accumulator circuit comprising a valve for setting the initial operating pressure.

9. A boat according to claim 1, wherein the boat includes a bottom, said boat bottom comprising means which enable it to be supported steadily on a planar surface.

10. A boat according to claim 9, having a hull which is of the catamaran type.

11. A boat according to claim 1, wherein the boat includes a boat bottom, said boat bottom being provided with an opening giving passage to the lower end of the cable for allowing said cable end to be attached to a mooring point.

12. A boat according to claim 11, wherein the lower end of the cable is anchored by means of a hook comprising a safety release device operated by severing.

13. A boat according to claim 2, said traction means including a capstan and wherein the cable is passed through a hydraulic damper unit between the lower outlet of the guide member and the capstan.

14. A boat according to claim 6, including a boat bottom, said boat bottom being provided with an opening giving passage to the lower end of the cable for allowing said cable end to be attached to a mooring point.

* * * * *